US005093961A

United States Patent [19]

Temburg

[11] Patent Number: 5,093,961

[45] Date of Patent: Mar. 10, 1992

[54] METHOD OF OPENING FIBER BALES

[75] Inventor: Josef Temburg, Jüchen, Fed. Rep. of Germany

[73] Assignee: Trutzschler GmbH & Co., Fed. Rep. of Germany

[21] Appl. No.: 606,834

[22] Filed: Oct. 31, 1990

[30] Foreign Application Priority Data

Nov. 4, 1989 [DE] Fed. Rep. of Germany ..... 3936810

[51] Int. Cl.[5] ..... D01G 7/14

[52] U.S. Cl. ..... 19/80 R; 19/145.5

[58] Field of Search ..... 19/80 R, 81, 97.5, 105, 19/145.5

[56] References Cited

U.S. PATENT DOCUMENTS

| | | | |
|---|---|---|---|
| 4,281,437 | 8/1981 | Marx | 19/145.5 X |
| 4,297,767 | 11/1981 | Leifeld | 19/145.5 X |
| 4,467,502 | 8/1984 | Lytton et al. | 19/145.5 X |
| 4,514,881 | 5/1985 | Hergeth et al. | 19/80 R |
| 4,707,888 | 11/1987 | Binder et al. | 19/81 X |
| 4,748,725 | 6/1988 | Temburg et al. | 19/81 X |
| 4,796,335 | 1/1989 | Kranefeld et al. | 19/80 R |
| 4,928,354 | 5/1990 | Hanselmann et al. | 19/80 R X |
| 4,984,336 | 1/1991 | Hanselmann et al. | 19/80 R |
| 4,995,142 | 2/1991 | Binder et al. | 19/97.5 X |

FOREIGN PATENT DOCUMENTS

| | | | |
|---|---|---|---|
| 0326913 | 8/1989 | European Pat. Off. . | |
| 3513295 | 10/1986 | Fed. Rep. of Germany . | |
| 3706268 | 9/1988 | Fed. Rep. of Germany . | |
| 8910761 | 2/1990 | Fed. Rep. of Germany . | |
| 1276693 | 12/1986 | U.S.S.R. | 19/80 R |
| 2170520 | 8/1986 | United Kingdom | 19/80 R |
| 2175927 | 12/1986 | United Kingdom . | |

OTHER PUBLICATIONS

Promoli, "Microelectronics in Preparatory Operations for Spinning", Melliand Textilberichte, 1/1982, pp. 14–18.

*Primary Examiner*—Werner H. Schroeder
*Assistant Examiner*—Ismael Izaguirre

[57] ABSTRACT

A method of operating a bale opener arranged for alternating forward and reverse travel along a series of fiber bales and having an opening device including an opening roll for removing fiber tufts from top faces of the fiber bales. The opening roll has unidirectionally inclined teeth. The opening device further has a grate arranged for pressing down on the top faces of the fiber bales and formed of grate bars between which the teeth of the opening roll project. The method includes the following consecutive steps: lowering the opening device immediately prior to a forward working pass, whereby the opening roll executes a downward feed motion; moving the opening device in a forward travelling direction for causing an execution of the forward working pass; and moving the opening device, without an immediately preceding lowering thereof, in a rearward travelling direction for causing an execution of a reverse working pass.

7 Claims, 5 Drawing Sheets

METHOD OF OPENING FIBER BALES

CROSS REFERENCE TO RELATED APPLICATION

This application claims the priority of Federal Republic of Germany Application No. P 39 36 810.6 filed Nov. 4th, 1989, which is incorporated herein by reference.

BACKGROUND OF THE INVENTION

This invention relates to a method and apparatus for removing fiber tufts from the top of textile fiber bales such as cotton bales, chemical fiber bales or the like, in which an opening device is moved back and forth above the top face of the serially arranged fiber bales and in which the opening device is incrementally lowered prior to the beginning of each pass. The opening device has an opening roll provided with teeth which are unidirectionally obliquely oriented and engage into the top face of the fiber bales as they project downwardly between generally horizontally oriented grate bars.

In a known process in which the teeth of the opening roll are obliquely oriented in the same direction, the opening device executes a working pass (that is, a pass during which fiber tufts are removed) only in one direction of travel, in which the opening roll is so rotated that in the working zone it moves opposite to the direction of travel. Such a direction of travel of the opening device will be referred to as forward travel (or pass in the forward direction). Subsequently, the opening device is moved in an idling state above the fiber bales in the reverse direction, and thereafter, it is lowered deeper than at the preceding pass and starts a new working pass in the forward direction. It is disadvantage of this arrangement that the fiber output of the bale opener is limited, since no fiber tufts are removed during the reverse pass.

SUMMARY OF THE INVENTION

It is an object of the invention to provide an improved method and apparatus of the above-outlined type from which the discussed disadvantage is eliminated and which thus has a higher output and executes working passes in both the forward and the reverse directions with an equalized removal of fiber quantities.

This object and others to become apparent as the specification progresses, are accomplished by the invention, according to which, briefly stated, the opening device executes a working pass in the forward direction immediately after an incremental lowering thereof and after the forward pass the opening device executes a working pass in the reverse direction or consecutive working passes in the reverse and forward directions without a preceding lowering of the opening device.

Thus, according to the invention, while the opening roll continues to rotate in the same direction, the opening device executes working passes both during forward and reverse travel, thereby increasing the output of the bale opener. By virtue of the fact that the bale opener is not lowered after each pass, but travels, subsequent to a single downward feed of the opening device, first in the forward and then in the reverse direction, the output quantities for each direction are equalized. The incremental distance by which the opening device is lowered is, for example, 2 mm and during the pass immediately following such a lowering, the grate bars press down on the fiber material. Subsequent to such a pass, the elastic fiber mass expands upwardly and during the consecutive pass without lowering, the tuft removal is more vigorous and the fiber layer thickness due to the resilient expansion is thereby taken off.

It is conventional, to be sure, to so operate the opening device that it executes a working pass in either direction. In such a device, however, the teeth of the opening rolls are divided equally to point in the forward and in the reverse direction so that during each pass only one half of the totality of teeth is fully utilized to yield a high output. Or, if all the teeth are identically oriented, the direction of rotation of the opening roll has to be reversed after each pass.

According to a preferred embodiment of the invention, the opening device, after each downward feed, executes a forward working pass, followed by a reverse working pass without lowering. According to another preferred embodiment of the invention, one cycle of operation comprises, in sequence, the lowering of the opening device, the forward working pass, a slight raising of the opening device and a reverse working pass.

According to a further feature of the invention, the vertical distance between the lowest location of the opening roll and the underside of the grate is varied to control the depth of penetration of the teeth of the opening roll into the fiber bales.

The apparatus for performing the process according to the invention has an opening device which is movable back and forth above the fiber bales and is lowerable prior to a working pass. The opening device has an opening roll provided with teeth oriented at the same inclination to a radial direction and projecting through grate bars for penetrating into the upper surface of the bales. A control device is provided which coordinates the vertical motion of the opening device and the travelling motion of a tower which carries the opening device. The control device is connected with a memory which expediently receives data for the vertical displacement of the opening device by a lifting motor and the longitudinal travel of the tower, driven by a drive motor. Expediently, in the memory, data for setting the vertical distance between the opening roll and the grate may be stored.

DESCRIPTION OF THE PREFERRED EMBODIMENTS

Figure 1:
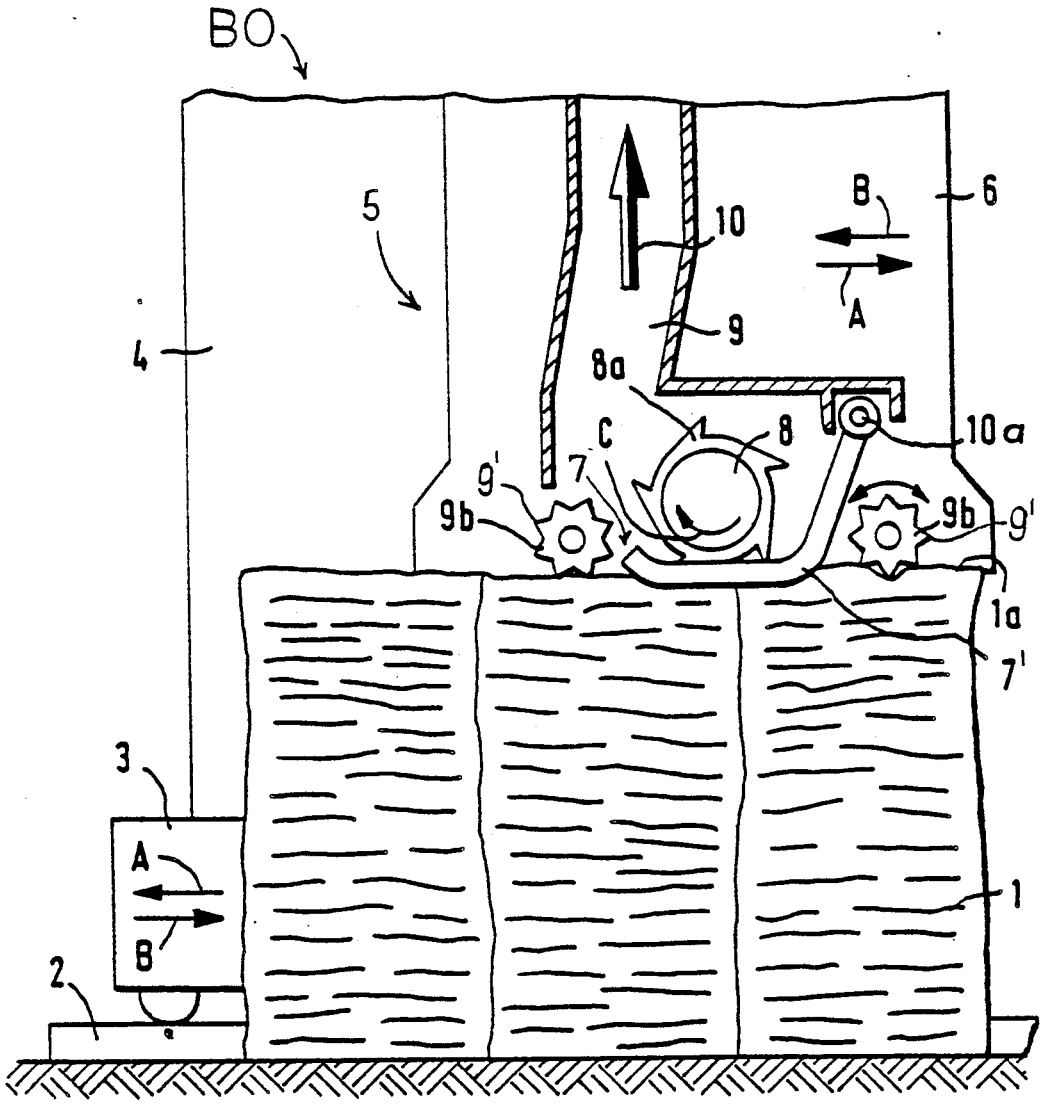
FIG. 1 is a schematic side elevational view of a bale opener for performing the process according to the invention.

Turning to FIG. 1, there is schematically illustrated therein a bale opener BO which may be, for example, a BLENDOMAT BDT model manufactured by Trüzschler GmbH & Co. KG, Mönchengladbach, Federal Republic of Germany. A series of fiber bales 1 is positioned along floor rails 2. A wheeled carriage 3 is arranged for travelling back and forth on the rails 2 in the direction of the arrows A and B. A tower 4, mounted on the carriage 3, supports an opening device 5 which may be raised and lowered relative to the tower 4. The opening device 5 has a housing 6 in which there is mounted an opening roll 8 rotated in the direction C, a grate 7 as well as a suction hood 9 extending over the opening roll 8. The grate 7 extends below the opening roll 8 and its grate bars 7′ (only one is visible) are arranged between axially spaced teeth 8*a* of the opening roll 8. The grate bars 7′ are spaced from one another horizontally in a direction which is perpendicular to the travelling direction A, B. Each grate bar 7′ essentially is formed of three zones: a first end, a mid zone and a second end. The two ends are oriented at an oblique angle to the horizontal, whereas the mid zone of each grate bar 7′ extends in a horizontal direction. Each grate bar 7′ is secured at one end to the housing 5 by a support element 10*a*. The grate 7 engages the top face 1*a* of each fiber bale 1 to thus hold down and stabilize the same. Further, the grate 7 prevents fiber layers from being horizontally torn or shifted by the opening roll 8. The opening roll 8 is flanked by axially parallel pressing rolls 9*a* and 9*b* which press down on the upper face 1*a* of the fiber bales 1. By virtue of this arrangement and because of the penetration of the teeth 9′ of the pressing rolls 9*a*, 9*b* into the fiber bales 1, the latter are maintained in position and are thus prevented from being shifted or from tipping over.

In operation the opening device travels above the free-standing fiber bales 1 back and forth while the teeth 8*a* of the opening roll 8 project downwardly between the underface of the grate 7 and penetrate into the fiber bales 1. The fiber tufts torn from the top face 1*a* of the fiber bales are thrown by the opening roll 8 upwardly into the suction stream 10 passing through the suction duct 9.

Figure 2A:
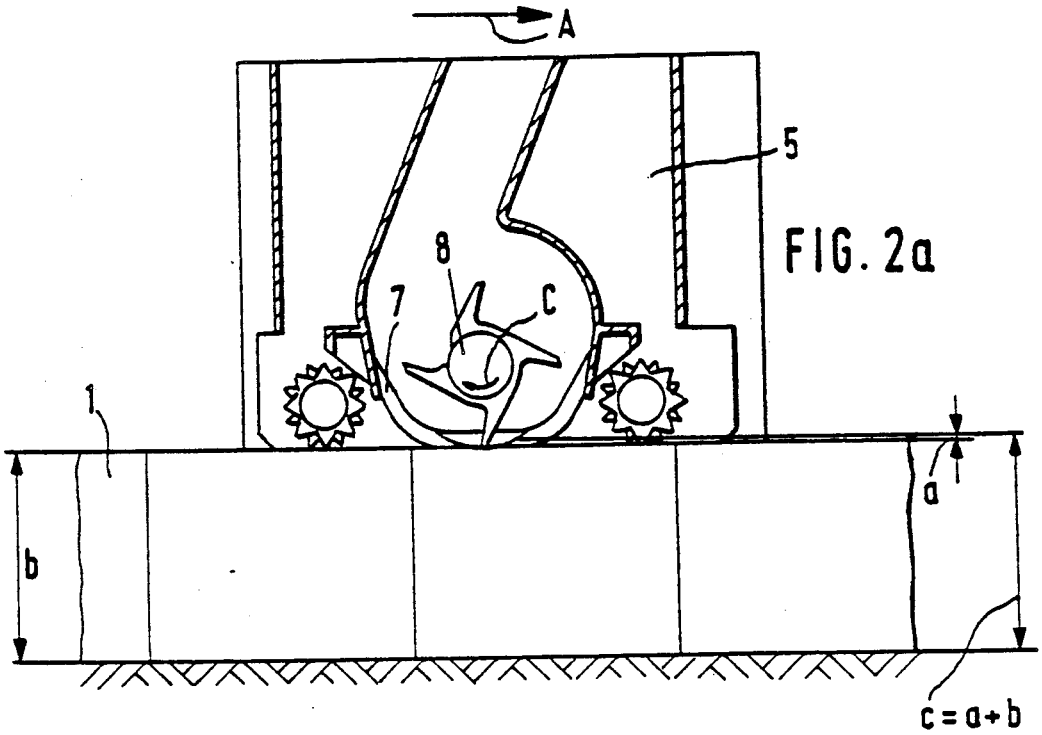
FIG. 2*a* is a schematic side elevational view of a bale opener depicted during the performance of a working pass in the forward direction with preceding lowering of the opening device.

Turning now to FIG. 2*a*, the height of the fiber bales is designated at c before starting the forward working pass in the direction A while b designates the height after fiber tuft removal. The downward feed of the opening device 5 effected before starting the forward working pass in the direction A is designated at a; thus, $c = a + b$. During the forward working pass the fiber bales 1 having a height c are compressed downwardly by the grate 7 to assume a height b and thus the opening roll 8 removes a thickness a from the fiber bales.

Figure 2B:
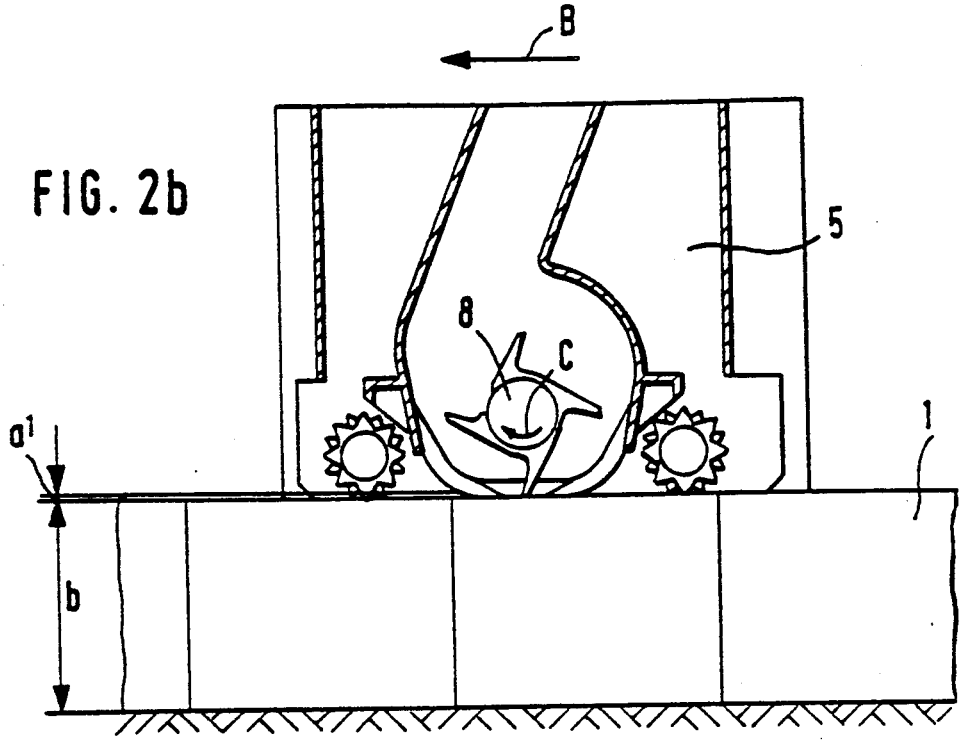
FIG. 2*b* is a schematic side elevational view of a bale opener depicted during the performance of a working pass in the reverse direction without preceding lowering of the opening device.

Turning to FIG. 2*b*, $a^1$ indicates the height which is added to the fiber bale height b due to the resilient, upward expansion of the fibers, so that prior to the working pass in the reverse direction B, the height of the fiber bales is $b + a^1$ and after the working pass in the reverse direction B the fiber bale height is b. Thus, in the reverse working pass the opening roll 8 removes a layer thickness $a^1$ from the fiber bales. Stated differently, during the reverse working pass only that fiber material is removed from the fiber bales which expands due to the resiliency of the fiber mass, upon release from under the grate 7. As a result, without a downward feed of the opening roll prior to the beginning of the reverse working pass, the removed quantities during the forward and reverse passes are maintained approximately at the same value.

Figure 2C:
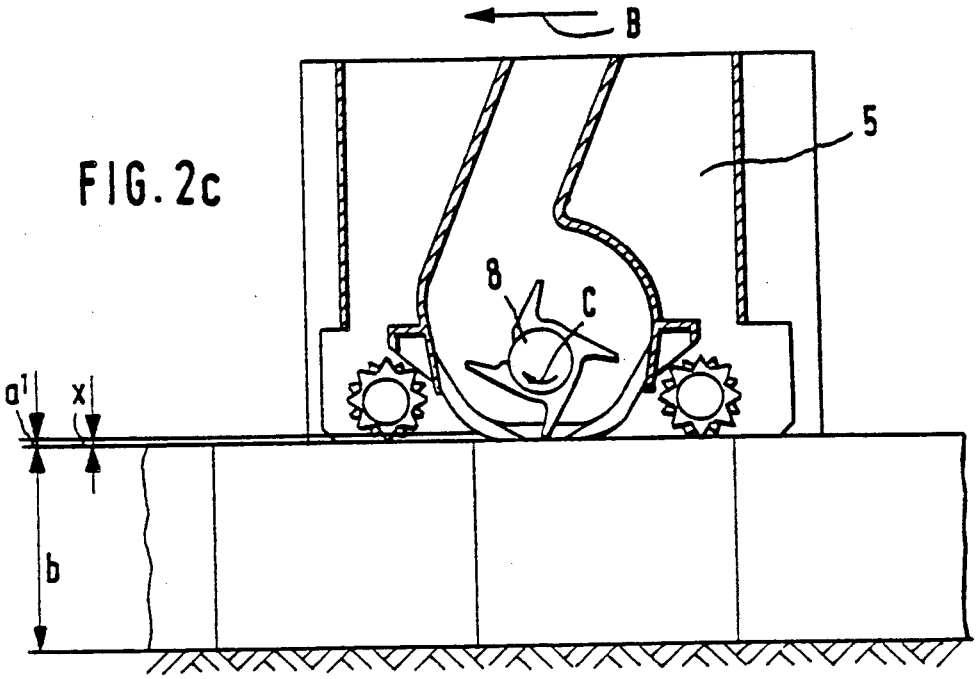
FIG. 2*c* is a schematic side elevational view of a bale opener depicted during the performance of a working pass in the reverse direction with preceding raising of the opening device.

Turning to FIG. 2*c*, the opening device 5 depicted therein performs a reverse working pass after it has been raised, following a forward working pass. One part of the fiber material which is expanding because of the resilient properties of the fiber mass, namely, the layer thickness x is removed during the reverse working pass.

Figure 3:
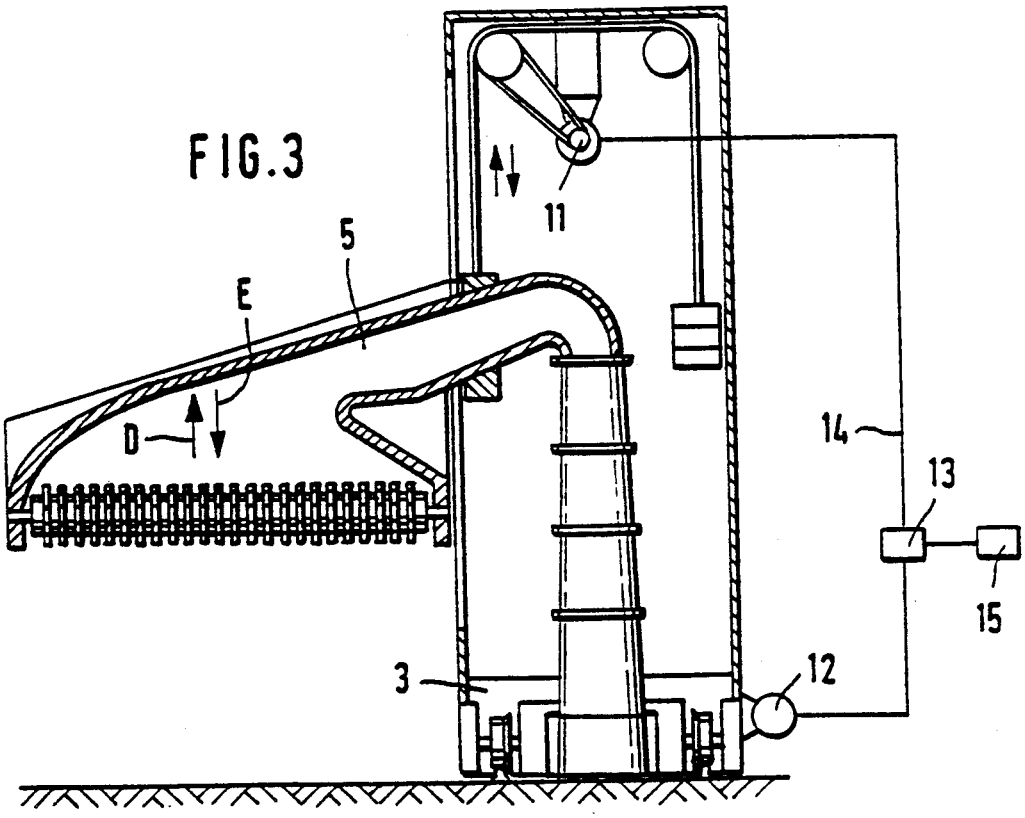
FIG. 3 is a schematic front elevational view of a bale opener according to a preferred embodiment of the invention.

The vertical shifting of the opening device 5 in the direction of arrows D and E as shown in FIG. 3, is effected by a lifting motor 11 while the travel of the carriage 3 in the direction A, B (FIG. 1) is effected by a drive motor 12. The lifting motor 11 and the drive motor 12 are connected by control cables 14 to a control device 13, such as a microcomputer provided with a microprocessor. The control device 13 is connected with a memory 15 in which information for the vertical shift by the lifting motor 11 and the longitudinal travel, effected by the drive motor 12, may be stored. Further, in the memory 15 information relating to the setting of the distance between the opening roll 8 and the grate 7 (FIGS. 5*a*, 5*b*) may be stored.

Figure 4:
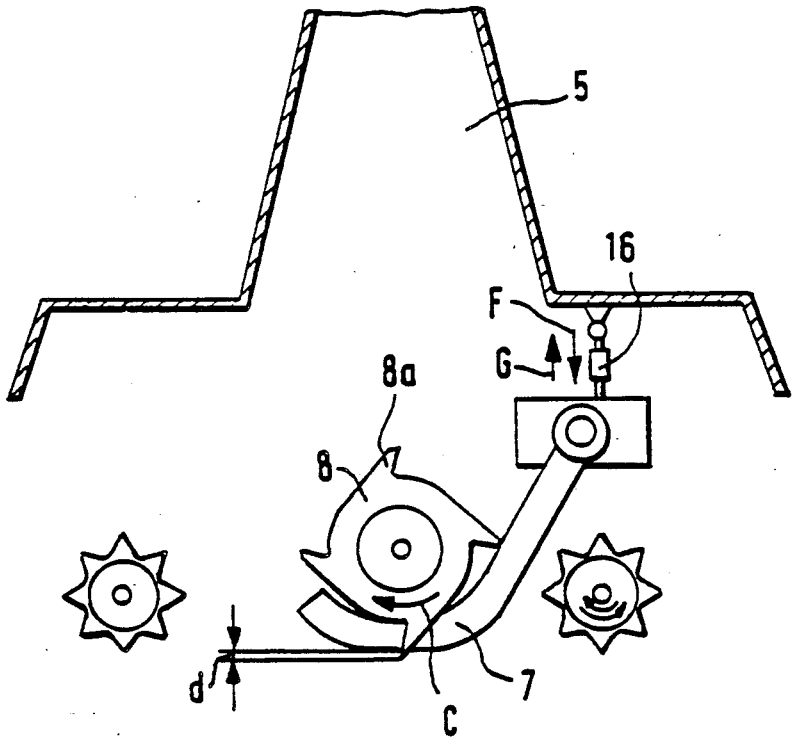
FIG. 4 is a schematic side elevational view of an opening device including an arrangement of varying the vertical distance between an opening roll and a grate.

Turning to FIG. 4, with the grate 7 there is connected a setting device such as a pneumatic cylinder 16 to vary the distance d between the point of the lowest lying tooth 8*a* of the opening roll 8 and the underside of the grate 7. Accordingly, the height of the grate 7 may be vertically changed by the cylinder 16 as indicated by the arrows F, G. The height position of the opening roll 8 remains unchanged.

Figure 5A:
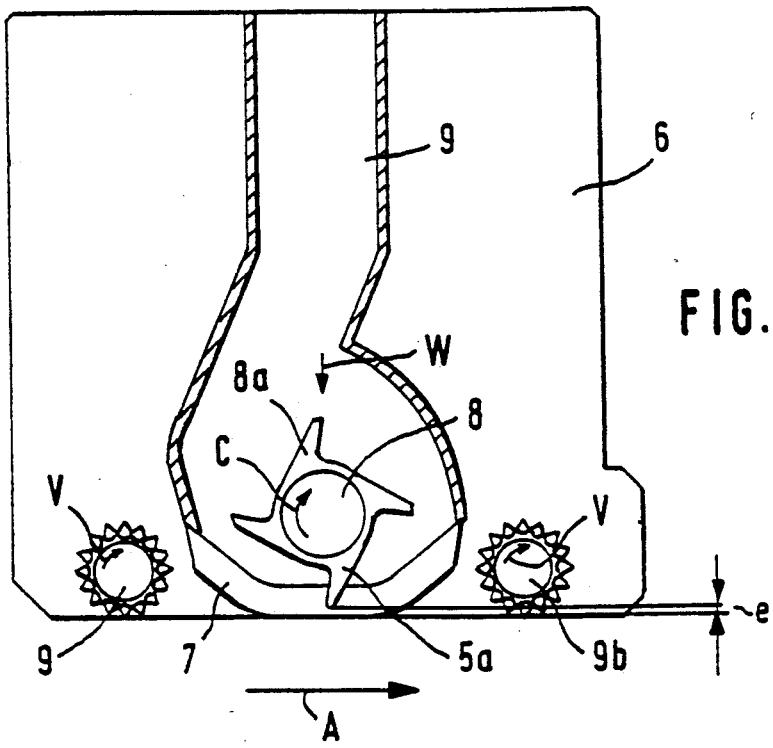
FIGS. 5*a* and 5*b* are schematic side elevational views of an opening device of a bale opener illustrating a setting of the vertical distance between the opening roll and the grate.
Figure 5B:
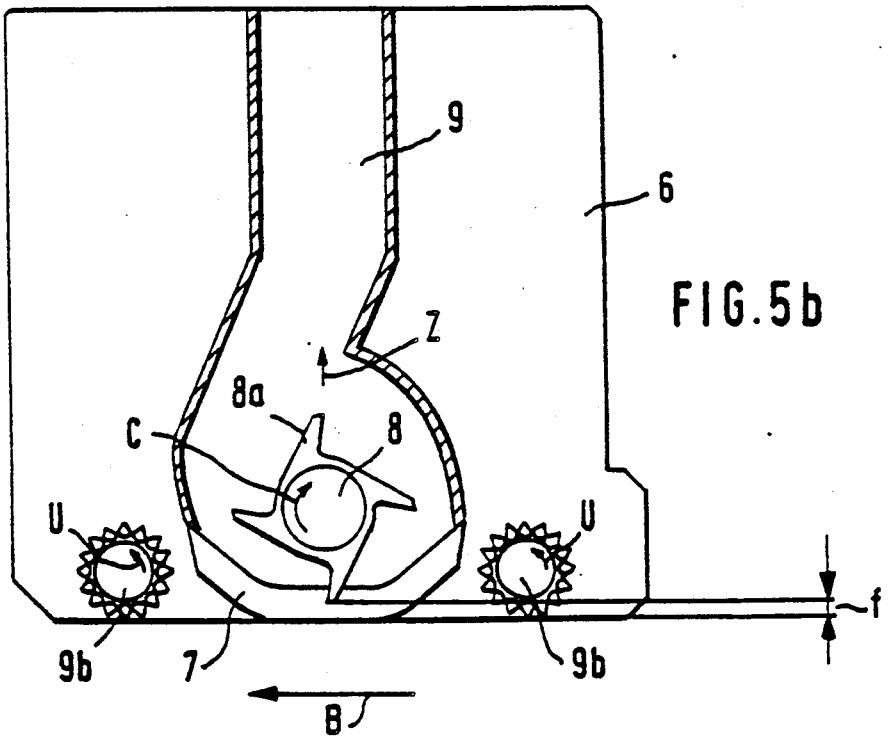

Turning to FIGS. 5*a* and 5*b*, the opening roll 8 is vertically adjustable in the directions of the arrows W and Z relative to the grate 7. In this manner, the distance between the point of the lowest lying tooth 8*a* of the opening roll 8 and the underside of the grate 7 may be changed from e to f (FIG. 5*b*) or conversely (FIG. 5*a*). In this embodiment, the height position of the grate 7 remains unchanged.

It is feasible to combine the embodiment of FIG. 4 with the embodiment shown in FIGS. 5*a* and 5*b* to arrive at a structure in which both the opening roll 8 and the grate 7 are height-adjustable.

The structural embodiments shown in FIGS. 4, 5*a*, and 5*b* provide for the performance of a further embodiment of the process according to the invention, namely, where a pass in the reverse direction B is effected without lowering of the opening device but with a change of the vertical distance between the opening roll 8 and the grate 7 to thus control the depth of penetration of the opening roll into the fiber bales.

It will be understood that the above description of the present invention is susceptible to various modifications, changes and adaptations, and the same are intended to be comprehended within the meaning and range of equivalents of the appended claims.

What is claimed is:

1. In a method of operating a bale opener executing alternating forward and reverse travel along a series of fiber bales and having an opening device including an opening roll for removing fiber tufts from top faces of the fiber bales; said opening roll having unidirectionally inclined teeth; said opening device further having a grate for pressing down on the top faces of the fiber bales and formed of grate bars; the teeth of the opening roll projecting between the grate bars; the improvement comprising the following consecutive steps:

(a) lowering said opening device immediately prior to a forward working pass, whereby said opening roll executes a downward feed motion;

(b) moving said opening device in a forward travelling direction for execution of said forward working pass; and (c) moving said opening device, without an immediately preceding lowering thereof, in a rearward travelling direction for execution of a reverse working pass.

2. A method as defined in claim 1, further comprising the step of cyclically repeating steps (a), (b) and (c) in a continuous sequence.

3. A method as defined in claim 1, further comprising the step of rotating said opening roll solely in a direction coinciding with the inclined orientation of said teeth; during forward working passes the forward travelling direction and the direction of rotation of the opening roll at said top faces are oppositely oriented.

4. A method as defined in claim 1, further comprising the step of maintaining said opening device, during step (c), at the same height level as during step (b).

5. A method as defined in claim 1, further comprising the step of raising said opening device immediately prior to step (c).

6. A method as defined in claim 1, further comprising the step of changing, after step (b) and before step (c), a vertical distance between a lowest point of said opening roll and an underside of said grate for setting the extent of penetration of said opening roll into said fiber bales during step (c).

7. In a method of operating a bale opener executing alternating forward and reverse travel along a series of fiber bales and having an opening device including an opening roll for removing fiber tufts from top faces of the fiber bales; said opening roll having unidirectionally inclined teeth; said opening device further having a grate for pressing down on the top faces of the fiber bales and formed of grate bars; the teeth of the opening roll projecting between the grate bars; the improvement comprising the following steps:

(a) moving said opening device alternately in forward and reverse travelling directions for execution of alternating forward and reverse working passes;

(b) lowering said opening device prior to each forward and each rearward working pass for executing a downward feed motion;

(c) changing, between working passes, the vertical distance between a lowest point of said opening roll and an underside of said grate for setting the extent of penetration of said opening roll into said fiber bales during each working pass; and (d) rotating said opening roll solely in a direction coinciding with the inclined orientation of said teeth.

* * * * *